US005257703A

United States Patent [19]

Ascik et al.

[11] Patent Number: 5,257,703

[45] Date of Patent: Nov. 2, 1993

[54] VERTICALLY EXPANDABLE MERCHANDISE DISPLAY STAND

[75] Inventors: Mark A. Ascik, Ormond Beach; Greg M. Jones, Holly Hill, both of Fla.

[73] Assignee: Capo, Inc., Ormond Beach, Fla.

[21] Appl. No.: 904,753

[22] Filed: Jun. 26, 1992

[51] Int. Cl.[5] ..... A47F 5/12

[52] U.S. Cl. ..... 211/166; 211/13; 211/208

[58] Field of Search ..... 211/166, 13, 163, 208, 211/196; 248/902, 220.2, 223.4

[56] References Cited

U.S. PATENT DOCUMENTS

| | | | |
|---|---|---|---|
| 437,247 | 9/1890 | Rouse | 211/165 |
| 475,120 | 5/1892 | Klingenberg | 211/163 |
| 2,808,941 | 10/1957 | Foster | 211/163 |
| 3,051,320 | 8/1962 | De loss Barnett | 211/196 |
| 3,194,403 | 7/1965 | Van Horn, Jr. | 211/166 |
| 3,862,735 | 1/1975 | Cohen | 248/405 |
| 3,884,357 | 5/1975 | Bloch | 211/13 |
| 3,891,092 | 6/1975 | Surrett et al. | 211/13 |
| 3,942,647 | 3/1976 | Crosslen | 211/144 |
| 4,157,760 | 6/1979 | Wilson | 211/13 |
| 4,211,331 | 7/1980 | Salmon et al. | 211/13 |
| 5,052,563 | 10/1991 | Camp | 211/13 |
| 5,054,624 | 10/1991 | Camp | 211/13 |
| 5,064,077 | 11/1991 | Mitchell | 211/60.1 |

*Primary Examiner*—Mark Rosenbaum
*Assistant Examiner*—Chuck Y. Mah
*Attorney, Agent, or Firm*—Jacques M. Dulin; Thomas C. Feix

[57] ABSTRACT

A rotatable and vertically expandable/contractible merchandise display stand including a base assembly, an intermediate display assembly and a top mounted crown assembly all arranged coaxially about a longitudinally oriented center shaft member. The intermediate display assembly comprises a generally elongated cylindrical hollow shell structure having top and bottom end walls arranged orthogonal to the longitudinal center shaft and a pair of parallel intermediate support members all of which support a pair of overlapping top and bottom half perimeter shell enclosures wherein each perimeter shell enclosure consists of a plurality of vertically oriented, side by side adjacently stacked display panel members. The top end wall is rotatably mounted to the crown assembly and the bottom end wall is rotatably mounted to the base assembly. Height adjustment means are provided to both the base assembly and crown assembly and are operative to raise or lower the top and bottom end walls of the intermediate display assembly such that the overlapping top and bottom perimeter shell enclosures collapse or expand in telescoping fashion to decrease or increase the merchandise display surface area of the display panels.

16 Claims, 2 Drawing Sheets

VERTICALLY EXPANDABLE MERCHANDISE DISPLAY STAND

BACKGROUND OF THE INVENTION

1. Field of the Invention

The present invention relates generally to merchandise display apparatus. More particularly, the present invention relates to a carousel-type merchandise display stand which is vertically adjustable to permit expansion or contraction of the display surface area in accordance with the seasonal nature of the display items such that the display assembly has an attractive, well balanced and fully stocked inventory appearance at all times.

2. Brief Description of the Prior Art

In the retail sales area it is important for the retailer to present a balanced, "full-looking" display of merchandise items in order to ensure steady sales. A display of a depleted stock of merchandise makes a bad impression on the consumer and will kill sales.

A particular problem often encountered by the retailer with the display of merchandise such as small holiday gift merchandise or seasonal items (e.g. men's wallets, jewelry, sunglasses, etc.) is how to maintain an attractive, well balanced display while using a minimum amount of valuable floor/counter space for the display. In the field of eyeglass/sunglass displays, for example, it is desirable to display varying amounts of inventory from season to season since the "in stock" inventory changes according to seasonal consumer demand. Thus, during the summer months when sunglasses are popular, a larger amount of display area (and inventory) is required whereas in the winter months a lesser amount is required to meet the consumer demand.

For many retailers, small inventory levels mean discontinuance of the product altogether because a small amount of product on a large display looks bad and kills sales and the retailers cannot afford to maintain a full display. Using a smaller display in turn cannot accommodate larger inventories during peak selling months.

Typical sunglass/eyeglass display stands include the carousel-type counter top displays and the free standing rotatable floor display models commonly found in most department and retail stores. Example prior art patents which disclose rotatable or carousel-type sunglass/merchandise display stands include U.S. Pat. No. 2,808,941 issued to Foster, U.S. Pat. No. 3,884,357 issued to Bloch, U.S. Pat. No. 4,157,760 issued to Wilson, U.S. Pat. No. 3,942,647 issued to Crosslen, U.S. Pat. No. 4,211,331 issued to Salmon et al., U.S. Patent Nos. 5,052,563 and 5,054,624 both issued to Camp, and U.S. Pat. No. 5,064,077 issued to Mitchell. None of the above cited prior art patent documents teach to adjust the size of the merchandise display area on their display stands to achieve a "full look" of display items on the stand.

To overcome the display size limitation problem, many retailers use one or more different display stands which vary in display area so that the selected display stand always appears fully stocked no matter the season. However, this poses another problem for the retailer since the additional unused display stands take up valuable floor space and must be stored off-site during the off season for the particular display item. Further, these display stands are heavy and cumbersome to move around and contain modular component parts which tend to come loose and get lost during such a move. This becomes a big problem when additional or larger display stands must be continuously carted back and forth between storage and the retail floor area for the many periodic promotions put on by the average retailer.

Another approach to resolving the display area size limitation problems is to provide a display stand with layers of removable display racks. For example, in U.S. Pat. No. 3,891,092 issued to Surrette et al. there is disclosed a rotary sunglass display stand which includes a plurality of display rack holders attached to a central rotatable shaft member wherein each holder supports a display rack containing a dozen sunglasses. Surrette's sunglass display stand includes a "strip down" feature whereby individual display racks may be removed from their holders to reveal an inner core of similarly supported sunglass display racks to achieve a reduction in the total number of sunglasses on display racks from 12 dozen (12 racks) to 3 dozen (3 racks). A disadvantage with this system is the difficulty in accessing or even viewing a particular pair of sunglasses disposed along an inner core display rack without first removing an overlying outer core display rack.

From U.S. Pat. No. 3,862,735 issued to Cohen it is known to provide a rotatable garment display rack with a vertical height adjustment means which includes a clutch member for engaging a threaded shaft disposed internal of a telescoping main support rod wherein disengagement of the clutch member permits vertical adjustment of the main support rod. Cohen teaches to provide vertical height adjustment to raise or lower a hoop member for hanging like sized garments (which are positioned on hangers) therefrom. Cohen is directed towards displaying garments of different sizes and does not teach or suggest to adjust the merchandise display surface area on his stand in a manner which increases or decreases the number of display items which may be positioned thereon.

Accordingly there is a definite need in the art for a rotatable merchandise display stand which includes an expandable display surface area to permit year-round display of varying quantities of product while maintaining the look of a full display and which permits easy access to all merchandise items on the display. There is a need for a display stand of the above kind which is low cost and simple to operate.

SUMMARY OF THE INVENTION

List of Objectives

It is therefore a principal objective of the present invention to provide a rotatable merchandise display stand which is vertically adjustable to expand or contract the amount of merchandise display surface area as desired to achieve an attractive and professional display of inventory.

It is another object of the invention to provide an expandable merchandise display stand of the type described which permits quick and easy size adjustment of the display area without tools.

It is another object of the present invention to provide an expandable rotatable merchandise display stand of the type described which includes a mirror for viewing a display item such as a pair of sunglasses or jewelry when worn by a user standing in front of the display stand and wherein the mirror includes tilt adjustment means for convenient viewing irrespective of the height adjustment of the display stand.

It is another object of the present invention to provide a height adjustable merchandise display stand which is of low cost.

Briefly, a preferred embodiment of the present invention comprises a rotatable and vertically expandable/-contractible merchandise display stand which includes a base assembly, an intermediate display assembly and a top mounted crown assembly, all arranged coaxially about a longitudinally oriented center shaft member. The intermediate display assembly comprises a generally cylindrical elongated hollow shell structure having top and bottom end walls arranged orthogonal to the longitudinal center shaft and a pair of parallel intermediate support members all of which support a pair of overlapping top and bottom half perimeter shell enclosures wherein each perimeter shell enclosure consists of a plurality of vertically oriented, side by side adjacently stacked display panel members. The top end wall is rotatably mounted to the crown assembly and the bottom end wall is rotatably mounted to the base assembly. Height adjustment means are provided to both the base assembly and crown assembly and are operative to raise or lower the top and bottom end walls of the intermediate display assembly such that the overlapping top and bottom perimeter shell enclosures collapse or expand in telescoping fashion to decrease or increase the merchandise display surface area of the display panels.

In a preferred embodiment the height adjustment means comprise worm gear-type assemblies whereby the center shaft is provided with screw members mounted adjacent top and bottom end portions thereof and which are receivingly engaged by threaded upper and lower yoke members provided to the crown and base assemblies, respectively, such that rotation of the crown and/or base assembly advances the respective yoke member and associated assembly along the screw member in the vertical direction. The base assembly further comprises a pair of internesting barrel-like members including a first stationary inner core member for securely anchoring the center shaft and a second outer perimeter shell member containing the bottom yoke member. Rotation of the outer perimeter shell member in the clock wise direction moves the perimeter shell member upward and causes and elongation appearance in the base assembly.

The crown assembly is defined as a drum-like member and preferably has a perimeter wall height sufficient for the display of an advertiser's name and/or logo. A plurality of mirrors are provided along the perimeter wall so that a consumer may view his or her reflection while wearing a display item (such as jewelry or a pair of sunglasses) selected from the panel display. Also, the mirror assemblies preferably include tilt means for adjusting the angle of the reflective mirror surface thus permitting the consumer to stand within a convenient distance from the display stand to view his or her reflection in the mirror irrespective of the height of the crown assembly above the floor level.

List of Advantages

An important advantage of the present invention is that it provides the retailer with greater flexibility in handling certain seasonal items of inventory, such as, for example sunglasses, whereby the retailer is able to stay in the sunglass business year-round while maintaining a full looking display and is able to take full advantage of the peak selling months by enlarging the display. Use of the invention also frees up cash during off-peak intervals when lesser inventories are required.

Another advantage of the present invention is that the expandable/contractible display surface enables the retailer to maintain a more professional looking display and will help to increase annual sales per square foot and obviates the need for different size displays for different selling seasons.

These and other objects and advantages of the present invention will no doubt become apparent to those skilled in the art from the following drawings, detailed description of the preferred embodiment and the appended claims.

IN THE DRAWING

FIGS. 3–5 is a series of perspective views illustrating three use positions for the expandable display stand of the present invention in which: FIG. 3 shows a fully expanded position; FIG. 4 shows a halfway contracted middle position; and FIG. 5 shows a fully contracted position.

DESCRIPTION OF THE PREFERRED EMBODIMENT

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

Figure 1:
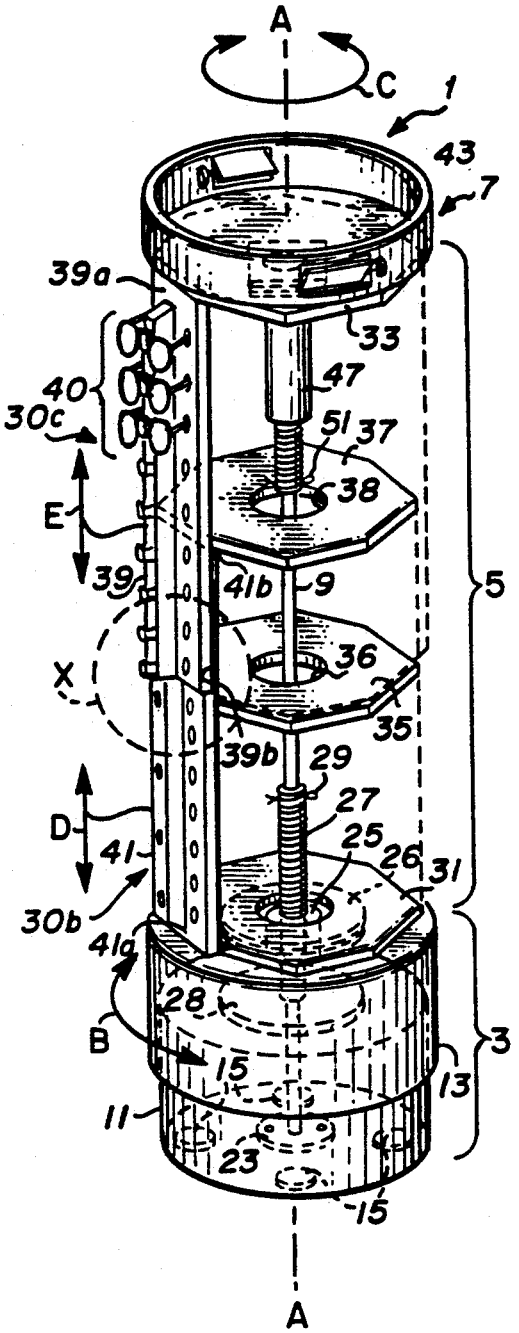
FIG. 1 is a perspective view of the vertically expandable merchandise display stand constructed in accordance with one embodiment of the present invention.
Figure 2:
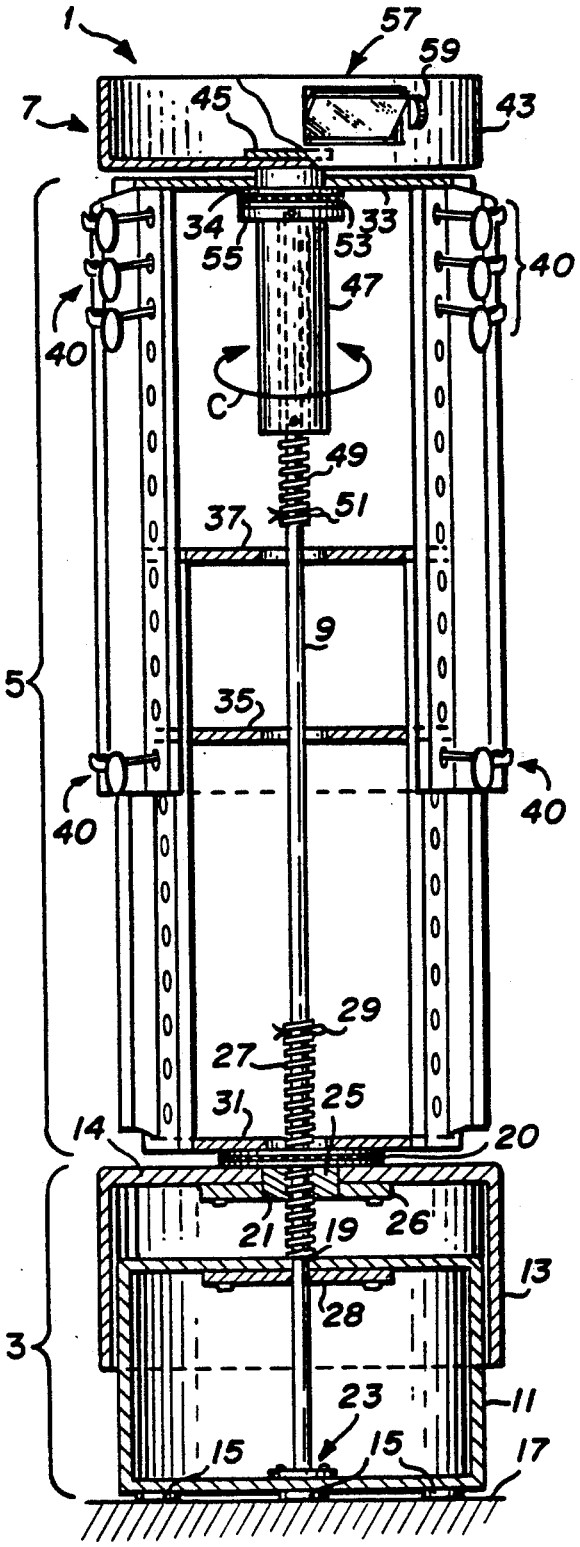
FIG. 2 is side elevation view in partial cross section of the display stand of FIG. 1.

With reference now to the drawings and in particular to FIGS. 1–2 thereof, a vertically adjustable merchandise display stand constructed in accordance with one embodiment of the present invention and indicated generally by the reference numeral 1 will be described.

The display stand 1 is generally defined as an elongated cylindrical structure broadly comprising a base assembly 3, an intermediate display assembly 5 rotatably mounted to the base assembly 3, and a crown assembly 7 rotatably mounted to the intermediate display assembly 5. All three assemblies 3, 5, 7 are symmetrically arranged along a common longitudinal axis A—A having their respective centers co-aligned with a center support shaft 9.

The base assembly 3 further comprises a pair of internesting barrel-like members including a first, inner base core member 11 and a second, outer perimeter shell member 13. The base core member 11 preferably includes a plurality of spacer pads 15 for providing non skid contact with the floor or counter surface 17 on which the base assembly rests (see FIG. 2). At its bottom most end, the center shaft 9 is securely anchored to the base core member 11 by a fastener 23. The base core member 11 and outer perimeter shell member 13 are provided with co-aligned through holes 19 and 21, respectively for receiving the center shaft 9 therethrough.

In the preferred embodiment, both inner core member 11 and outer perimeter shell 13 are fashioned as thin shelled structural elements fabricated from plastic laminated particle board for lightness. Accordingly, the top wall 14 (see FIG. 2) of base core member 13 preferably includes an added support member 28 including a center through hole (not shown) for receiving the center shaft therethrough. The additional support member 28 ensures that the shaft 9 is maintained in vertical alignment without undue wobble about the longitudinal axis A—A. Alternatively, the base core member 11 may be a solid block of material having a central bore hole for supporting the bottom most portion of the center shaft 9.

Height adjustment means are provided to the base assembly 3 to raise the outer perimeter shell 13 with respect to the base inner core member 11. In a preferred embodiment, the height adjustment means consists of a worm gear-type arrangement which includes screw member 27 provided to the shaft 9 and a cooperating threaded yoke 25 provided to the outer perimeter shell member 13. The through hole 21 of outer perimeter shell member 13 is fitted with the yoke 25 which is preferably secured to the second perimeter shell member by a spider support 26. The center yoke 25 includes a threaded bore hole for receivingly engaging the threads of the screw member 27 which is integrally connected to a bottom portion of center shaft 9. Alternatively, the spider support 26 may be eliminated such that the yoke 25 is simply press fit into the top wall 14 of the outer perimeter shell member 13.

In the preferred embodiment, the screw member 27 is fabricated from a hard plastic tubular stock having outer threads machined to a desired tolerance and having an inner diameter sufficient for a snug fit on the shaft 9 and is fixed thereto by means of a cotter pin 29. The screw receiving yoke 25 is preferably fabricated from a durable plastic compatible material such as delrin TM to provide a sufficient close tolerance fit with the threads of the screw member 27 for smooth and solid screw operation of the height adjustment feature. However, as will be appreciated by those skilled in the art, the selection of suitable materials for the various moving screw parts and fixture means are numerous and well known and accordingly will not be listed here.

Rotation of the outer perimeter shell member 13 in the direction of arrow B advances the threaded yoke 25 (and attached perimeter outer shell member 13) along the bottom screw member 27 of center shaft 9 to either raise or lower the height of the outer perimeter shell member 13 with respect to the stationary base core member 11. In the preferred embodiment of the present invention, all threaded portions are standard right hand thread such that a rotational movement generates a vertically upward or rising movement and rotation in the counter clockwise direction generates a vertically downward or lowering movement.

The intermediate display assembly 5 comprises a generally elongated cylindrical hollow shell structure having a bottom end wall 31, top end wall 33 and two intermediate horizontal frame members 35 and 37. The perimeter walls are formed as two overlapping upper and lower half shell enclosures 30*a*, 30*b*, each formed from a plurality of vertically oriented, side by side adjacently stacked display panel members. Upper half shell enclosure 30*a* comprises upper panel members 39 and lower half shell enclosure 30*b* comprises lower panel members 41. The panel members 39, 41 are preferably selected from known plastic display panel member stock commonly used in present merchandise display stands. In the embodiment shown, the panel members 39, 41 are formed as molded polystyrene strips which have a raised center ridge having a plurality of holes for receiving hook members and a plurality of selectively spaced perforations along both side edges for receiving and supporting a display of merchandise items such as the example sunglasses collectively designated at 40 shown in FIGS. 1-2.

In the preferred embodiment the upper half perimeter shell enclosure 30*a* comprises eight upper panel members 39 and the lower half perimeter shell enclosure 30*b* comprises eight lower panel members 41 wherein each panel member is associated with a coordinate side edge of the octagonally shaped top and bottom end walls 33, 31 and the intermediate frame members 35, 37. It is understood that the invention should not be so narrowly construed as to cover only an eight sided panel display assembly, but would include numerous variations of other outer display surface perimeter shell configurations, including but not limited to a hexagonal perimeter displays, a four sided perimeter displays and a circular perimeter displays.

Each of the eight lower panel members 41 has a bottom end portion 41*a* secured to a coordinate side edge of the bottom end wall 31 and a top end portion 41*b* secured to a coordinate side edge of the upper horizontal frame member 37. The lower intermediate frame member 35 may also be used to buttress the lower panels 41 and limit flexure of the shell enclosure as desired. Each of the eight upper panel members 39 has a top end portion 39*a* secured to a coordinate side edge of top end wall 33 and a bottom edge portion 39*b* disposed to overlap the outward facing display surface of a coordinate lower panel 41.

For display stands having a longer overall height, it is useful to dimension through hole 36 of frame member 35 with a close tolerance fit (not shown) with the outer diameter of shaft 9 to limit the side to side movement of the middle portion of shaft 9 during use. Alternatively, for display stands of a smaller overall height, the intermediate frame member 35 may be eliminated as unnecessary. Note in FIGS. 1-2, a majority of the upper and lower display panel members 39, 41 are removed to reveal the interior space of the intermediate display assembly 5. A preferred embodiment of the invention showing a complete set of upper and lower panel members is best seen with reference to FIGS. 3-5.

The crown assembly 7 comprises a generally cylindrical drum-like member 43 having a height adjustment means similar to the height adjustment means described above in connection with the base assembly 3. The height adjustment means of the crown assembly 7 comprises a spider support 45 (which is either formed as a part of or attached to the base wall of the crown assembly 7) and an integrally attached yoke 47 which extends downwardly through a hole 34 provided in upper end wall 33 of intermediate display assembly 5. The yoke 47 includes a threaded bore hole for receivingly engaging the outer threads of an upper threaded screw member 49 provided to the upper end portion of shaft 9. As discussed above in connection with the lower screw member 27, the upper screw member securely attaches to the shaft 9 by a cotter pin 51.

A rotation of the crown assembly 7 in the direction of arrow C advances the threaded yoke 47 along the upper screw member 49 which results in raising or lowering the crown assembly 7 with respect to the floor or counter top 17 depending upon the direction of rotation. The crown assembly 7 further includes at least one mirror assembly 57 to permit a consumer to view his or her reflection when wearing a display item such as a pair of sunglasses or jewelry selected from one of the display panels 39 or 41. The mirror assembly preferably includes a tilt means such as a thumb wheel 59 for angular adjustment of the mirror's reflecting surface so that the consumer can view his or her reflection from one location a distance away from the display stand 1 irrespective of the height location that the crown assembly 7 is with respect to the floor or counter top 17.

Bearing means are provided for independent rotation of the intermediate display assembly 5 with respect to the base assembly 3 and the crown assembly 7. A first bearing means comprises a lower roller bearing assembly 20 disposed to connect the bottom end wall 31 of the intermediate display assembly 5 to top surface of outer perimeter shell member 13 of the base assembly. A second bearing means comprises upper roller bearing assembly 53 provided to permit rotation of the intermediate display assembly 5 with respect to the crown assembly 7. The upper roller bearing assembly 53 is mounted at its bottom end to a horizontally extended platform support 55 disposed in integral association with the upper yoke 47 and is connected at its top end to the underside of top end wall 33 of the intermediate display assembly 5.

Figure 3:
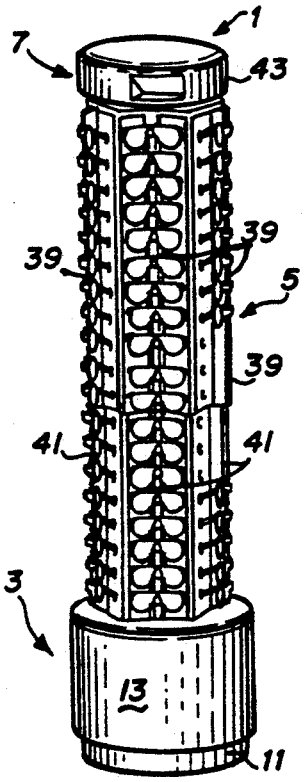

With reference to FIGS. 1-5, the vertical height adjustment operation of the invention will be described. As is best seen in FIG. 3, the display stand 1 is shown in a fully extended position wherein a maximum amount of merchandise display area is created, taking full advantage of the display surface area offered by both the upper display panels 39 of the upper half perimeter shell enclosure 30*a* and lower display panels 41 of the lower half perimeter shell enclosure 30*b*. In this position, the crown assembly 7 has been rotated in the clock wise direction of arrow C (FIG. 1) thus drawing the upper display panels 39 vertically upward. The base assembly 3 is also set to an initial position wherein the threaded yoke 25 of outer perimeter shell member 13 is at its lowest point of travel with respect to the stationary screw 27 such that the outer perimeter shell member 13 substantially encloses the stationary base core member 11.

Figure 4:
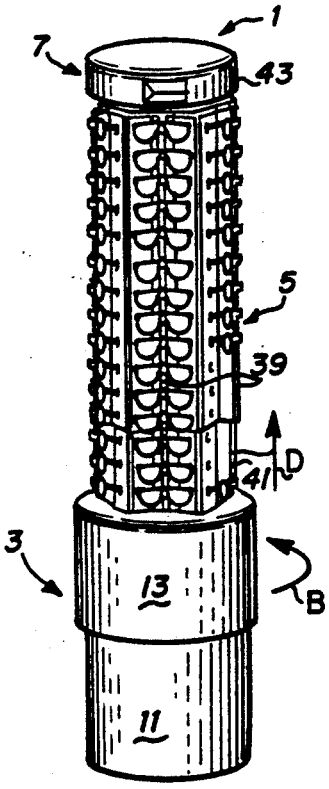
Figure 5:
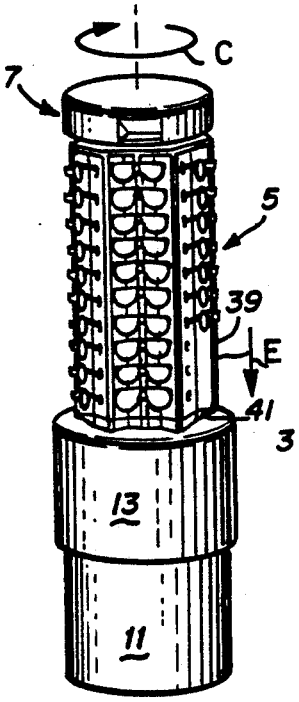

When the retailer desires a smaller merchandise display area, two display size adjustments are possible. The first adjustment involves the rotation of outer perimeter shell member 13 in the clockwise direction of arrow B as illustrated in FIG. 4. As discussed above with reference to FIGS. 1-2, a clockwise rotation of outer perimeter shell member 13 advances the integrally attached bottom yoke 25 upward along screw member 29 thus moving the lower display panels 41 of lower half perimeter shell enclosure 30*b* vertically upward in the direction of arrow D underneath the overlapping upper display panels 39 of upper half perimeter shell enclosure 30*a*. The effect is a telescoping contraction of the display surface area from the bottom upwards. During this operation the intermediate display assembly 5 remains substantially idle in the direction of angular rotation about the shaft 9 in view of the bottom roller bearing assembly 20 separating the intermediate display assembly 5 and the base assembly 3.

A further display area size adjustment involves the contraction from the top down direction whereby the crown assembly 7 is rotated counter clockwise in the direction of arrow C. This causes the upper display panels 39 to move vertically downward in the direction of arrow E. This is best seen with reference to FIG. 5. The effect of this top down telescoping contraction operation is an overall height reduction in the display stand 1.

As is evident from the drawings, the two display area size adjustment operations on the display stand of the present invention permit incremental increases or decreases in the total merchandise display surface area. Thus, the need for a retailer to switch back and forth between two different size display stands during the high and low selling periods for seasonal merchandise is obviated. Also, the retailer will be better able to move "in stock" inventory since a consumer is more apt to purchase items from a full-looking display.

Figure 6:
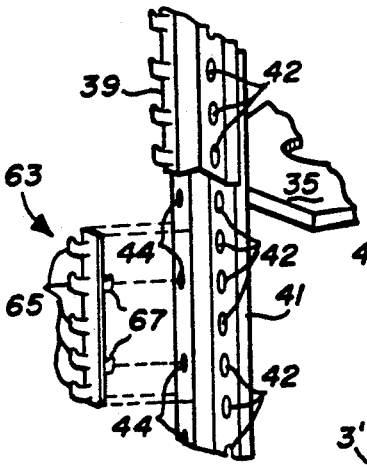
FIG. 6 is an enlarged fragmentary perspective view of the region X of FIG. 1 illustrating one embodiment for a detachable multi-prong member for supporting the nose bridge portion of eyeglasses.

FIG. 6 is an enlarged fragmentary view of the region X of FIG. 1 illustrating one embodiment for an add-on attachment 63 to the display panels 39, 41 for support of additional merchandise items. The provision of a detachable member to the lower display panels 41 such as the add-on attachment 63 facilitates the unobstructed overlapping telescoping movement of the upper display panels 39 with respect to the lower display panels 41 during the expansion or contraction operation of the display surface area as described above.

In the present example, the add-on attachment 63 includes five prongs 65 for supporting the nose bridge pieces of five individual pairs of eyewear (not shown). The add-on attachment 63 also includes two plug members 67 which are adapted to engage holes 44 provided in the raised center ridge member 46 of the display panel 41. The holes 42 provided along the side edges of the display panels 39 and 41 are for receiving the ear pieces of the provided display eyewear.

Figure 7:
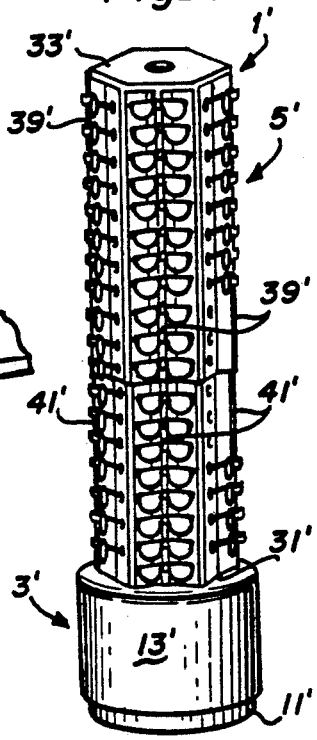
FIG. 7 shows an alternate embodiment of the present invention in a full expanded position.
Figure 8:
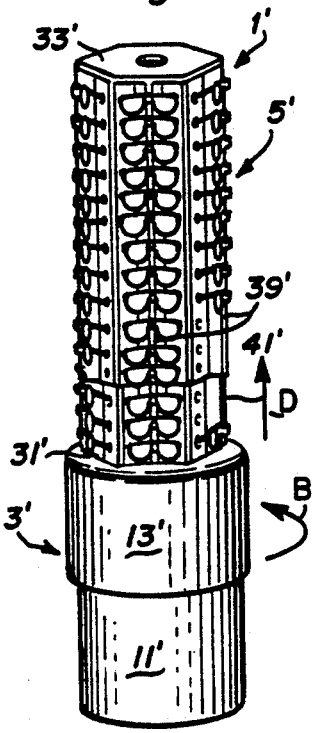
FIG. 8 shows the alternate embodiment of FIG. 7 in a contracted position.

FIGS. 7-8 show an alternate embodiment for the vertically expandable display stand 1' of the present invention wherein the crown assembly is removed. All reference numerals to elements common to the preferred embodiment shown in FIGS. 1-5 are indicated by primed numbers. In the alternate embodiment, vertical height adjustment means are provided to the base assembly 3' as described above with reference to FIGS. 1-2 such that the display assembly 5' contracts or expands by raising or lowering the bottom end wall 31'. Also, the shaft 9 (not visible in FIGS. 7-8) is preferably fixed at its upper end to top end wall 33' of the display assembly 5'.

It should be understood that various modifications within the scope of this invention can be made by one of ordinary skill in the art without departing from the spirit thereof. For example, while the height adjustment means described herein for producing the telescoping contraction and/or expansion of the display surface area of the intermediate display assembly are shown as worm gear-type assemblies, other known means for vertical height adjustment about a center axis could easily be substituted therefore without undue modification or deviation from the principles and teachings of the present invention, such as, for example, known pneumatic and/or hydraulic cylinder lift arrangements commonly found on height adjustable office chairs.

We therefore wish our invention to be defined by the scope of the appended claims as broadly as the prior art will permit, and in view of the specification if need be.

What is claimed is:

1. A merchandise display stand comprising in operative combination:

a) a base assembly:

b) an axial center shaft extending substantially vertically upward from said base assembly;

c) a generally elongated cylindrical display assembly disposed along said center shaft adjacent said base assembly and including top and bottom end walls and a pair of overlapping perimeter wall half shell enclosures including a top half shell enclosure connected to said top end wall and a bottom half shell enclosure connected to said bottom end wall, each of said top and bottom half shell enclosures having an outer display surface for supporting a plurality of like display items thereon;

d) a crown assembly disposed along said center shaft adjacent said top end wall of said display assembly; and e) means for adjusting the height distance of said top and bottom end walls with respect to each other such that said overlapping top and bottom half shell enclosures move in telescoping fashion to expand or contract the total outer perimeter display surface area of said display assembly.

2. A merchandise display stand as in claim 1 wherein:

a) said base assembly includes a first barrel-like inner core member and a second outer perimeter barrel-like shell member having an inner receiving surface configuration sized for nesting over an outer surface configuration of said inner core member; and b) said height adjusting means includes:

i) a first screw member secured to a bottom portion of said center shaft adjacent said base assembly; and ii) a first threaded yoke provided to said second outer perimeter shell member adapted to receivingly engage said first screw member and which advances along said first screw member so that said bottom end wall of said display assembly moves up or down as said outer perimeter shell is rotated in the clockwise or counterclockwise direction about the center shaft.

3. A merchandise display stand as in claim 2 wherein said height adjusting means further includes:

a) a second screw member secured to an upper portion of said center shaft adjacent said crown assembly; and b) a second threaded yoke provided to said crown assembly and adapted to receivingly engage said second screw member and for advancing along said second screw member so that said top end wall of said display assembly moves up or down as said crown assembly is rotated in the clockwise or counterclockwise direction about the center shaft.

4. A merchandise display stand as in claim 3 which includes a first bearing means for rotatably mounting said base assembly to said bottom end wall of said display assembly and a second bearing means for rotatably mounting said top end wall of said display assembly to said crown assembly.

5. A merchandise display stand as in claim 4 wherein said crown assembly includes at least one mirror.

6. A merchandise display stand as in claim 5 wherein said crown assembly further includes means for tilting said mirror to permit a consumer to remain at a convenient distance away from said display stand and view his or her reflection in said mirror irrespective of a height location of said crown assembly above floor level.

7. A merchandise display stand as in claim 6 wherein said outer display surfaces of said top and bottom half shell enclosures include a plurality of spaced holes for receiving add-on multi-prong hook attachments for supporting display merchandise, said add-on attachments being easily removable from said holes to permit unobstructed telescoping movement of said top and bottom half shell enclosures.

8. A merchandise display stand as in claim 1 wherein said height adjusting means includes:

a) an upper screw member secured to said center shaft adjacent said crown assembly; and b) an upper threaded yoke provided to said crown assembly and adapted to receivingly engage said upper screw member and for advancing along said upper screw member so that said top end wall of said display assembly moves up or down as said crown assembly is rotated in the clockwise or counterclockwise direction about the center shaft.

9. A merchandise display stand as in claim 8 which includes a first bearing means for rotatably mounting said base assembly to said bottom end wall of said display assembly and a second bearing means for rotatably mounting said top end wall of said display assembly to said crown assembly.

10. A merchandise display stand as in claim 9 wherein said crown assembly includes at least one mirror.

11. A merchandise display stand as in claim 10 wherein said crown assembly further includes means for tilting said mirror to permit a consumer to remain at a convenient distance away from said display stand and view his or her reflection in said mirror irrespective of a height location of said crown assembly above floor level.

12. A merchandise display stand as in claim 13 wherein said outer display surfaces of said top and bottom half shell enclosures include a plurality of spaced holes for receiving add-on multi-prong hook attachments for supporting display merchandise, said add-on attachments being easily removable from said holes to permit unobstructed telescoping movement of said top and bottom half shell enclosures.

13. A merchandise display stand comprising in operative combination:

a) a base assembly:

b) an axial center shaft extending substantially vertically upward from said base assembly;

c) a generally elongated cylindrical display assembly disposed along said center shaft adjacent said base assembly and including top and bottom end walls and a pair of overlapping perimeter wall half shell enclosures including a top half shell enclosure connected to said top end wall and a bottom half shell enclosure connected to said bottom end wall, each of said top and bottom half shell enclosures having an outer display surface for supporting a plurality of like display items thereon;

d) means for adjusting the height distance of said top and bottom end walls with respect to each other such that said overlapping top and bottom half shell enclosures move in telescoping fashion to expand or contract the total outer perimeter display surface area of said display assembly.

14. A merchandise display stand as in claim 13 wherein:

a) said base assembly includes a first barrel-like inner core member and a second outer perimeter barrel-like shell member having an inner receiving surface configuration sized for nesting over an outer surface configuration of said inner core member; and b) said height adjusting means includes:

i) a first screw member secured to a bottom portion of said center shaft adjacent said base assembly; and ii) a first threaded yoke provided to said second outer perimeter shell member adapted to receivingly engaging said first screw member and which advances along said first screw member so that said bottom end wall of said display assembly moves up or down as said outer perimeter shell is rotated in the clockwise or counterclockwise direction about the center shaft.

15. A merchandise display stand as in claim 14 which includes a first bearing means for rotatably mounting said base assembly to said bottom end wall of said display assembly.

16. A merchandise display stand as in claim 15 wherein said outer display surfaces of said top and bottom half shell enclosures include a plurality of spaced holes for receiving add-on multi-prong hook attachments for supporting display merchandise, said add-on attachments being easily removable from said holes to permit unobstructed telescoping movement of said top and bottom half shell enclosures.

* * * * *